US005275107A

United States Patent [19]

Weber et al.

[11] Patent Number: 5,275,107

[45] Date of Patent: Jan. 4, 1994

[54] GUN LAUNCHED NON-SPINNING SAFETY AND ARMING MECHANISM

[75] Inventors: Paul L. Weber, Eden Prairie; Peter H. Van Sloun, Hopkins, both of Minn.

[73] Assignee: Alliant Techsystems Inc., Edina, Minn.

[21] Appl. No.: 901,113

[22] Filed: Jun. 19, 1992

[51] Int. Cl.[5] ..... F42C 15/24; F42C 15/26

[52] U.S. Cl. ..... 102/251; 102/229; 102/247

[58] Field of Search ..... 102/229, 231, 233, 235, 102/247, 249, 251, 254

[56] References Cited

U.S. PATENT DOCUMENTS

| | | | |
|---|---|---|---|
| 4,128,061 | 12/1978 | Kaiser | 102/249 |
| 4,449,457 | 5/1984 | Halssig | 102/251 |
| 4,464,991 | 8/1984 | Kaiser | 102/233 |
| 4,691,634 | 9/1987 | Titus et al. | 102/229 |
| 4,796,532 | 1/1989 | Webb | 102/233 |
| 4,876,960 | 10/1989 | Schillinger et al. | 102/251 |
| 4,969,397 | 11/1990 | Günther et al. | 102/235 |
| 4,995,317 | 2/1991 | Bankel et al. | 102/239 |

OTHER PUBLICATIONS

Alliant Technology, "Introduction of the XM744 Fuze".

Alliant Technology, "Military Specification: Fuze, PIBD, XM740, Second Environment Sensor For" (1984).

Campagnuolo et al., "Induction Sensor to Provide Second Environmental Signature for Safing and Arming a Non-spin-Projectile Fuze" (1984).

*Primary Examiner*—David H. Brown

*Attorney, Agent, or Firm*—Merchant, Gould, Smith, Edell, Welter & Schmidt

[57] ABSTRACT

An safe and arm apparatus is disclosed wherein the apparatus utilizes setback acceleration for in-bore safety and sustained in-bore acceleration to position various members to allow for subsequent alignment of the firing train at arm time. The apparatus includes a rotor that houses an explosive lead and having a side bore hole formed therein which selectively interrupts the initiating explosive train both in front of and after the explosive train lead. The explosive interface between a detonator and a lead is unimpeded when the bore hole is in-line with a second corresponding hole in a protective cover. The rotor is normally secured by a setback lock and a shear tab. Upon launching from a gun, an in-bore lock (in conjunction with a retaining collar) moves down at a low acceleration level to additionally secure the rotor out-of-line while the projectile is in the gun tube. The movement of the in-bore lock also removes an impact drive surface for a piston actuator on the rotor, which eliminates the possibility of an in-bore-arming in the event of an inadvertent firing of the piston actuator. During the period in the gun tube, the setback lock also swings down under a predetermined high acceleration and causes the setback lock to latch, leaving the in-bore lock and a shear/break-away tab holding the rotor. Once out of the gun tube, the in-bore lock releases, leaving the rotor free (except for the shear tab which is overcome by the piston actuator) and restoring the impact drive surface of the piston actuator on the rotor. The electrically activated piston actuator is positioned to rotate and lock the rotor in line such that the detonator in the housing, the side bore hole in the rotor, the explosive lead in the rotor, and the bore hole in the cover are aligned for target initiated detonation. The piston actuator is controlled by an electronics assembly.

20 Claims, 8 Drawing Sheets

FIG. 2
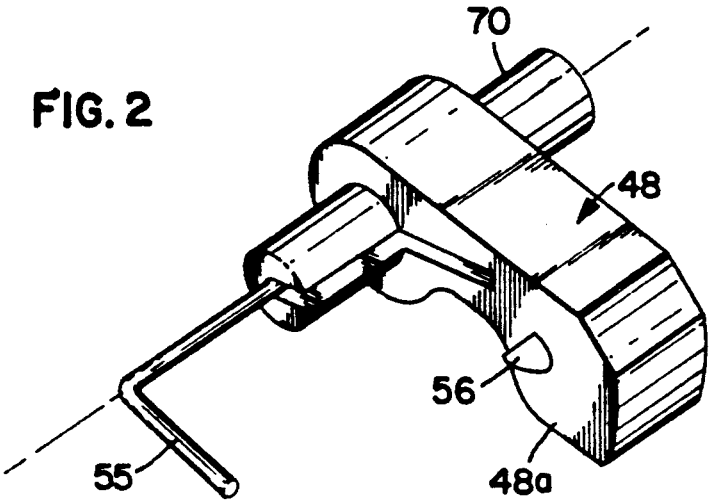
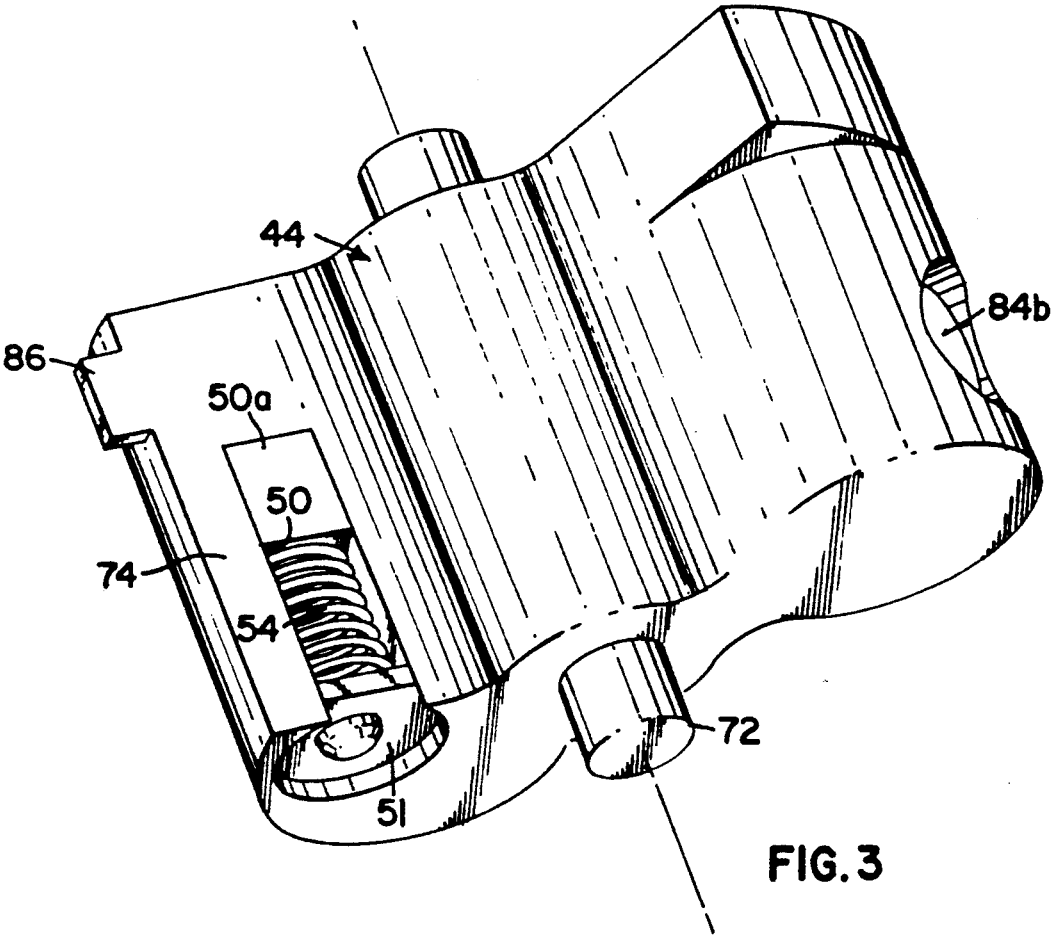
FIG. 3

GUN LAUNCHED NON-SPINNING SAFETY AND ARMING MECHANISM

FIELD OF THE INVENTION

This invention relates generally to explosive projectiles, and more particularly to a safety and arming device, for use in a fuze, which utilizes initial setback acceleration to lock the device in the safe position for in-bore safety, provides an out-of-line detonation train until safe separation, and requires sustained acceleration prior to allowing movement into the armed position.

BACKGROUND OF THE INVENTION

A munitions fuze must provide proper weapon system operation as well as be reliable in order to safely manufacture, store and use. Generally, the fuze must insure that there is no possibility of main warhead initiation until the munition is actually on its way to the target.

A part of every fuze device is the safety and arming (S&A) device; the function of which is to prevent the arming of the fuze until a specific set of conditions are met. This is accomplished by sensing arming environments, maintaining firing train safety and initiating the explosive train. Additionally, many S&A devices provide fuze timing functions for safe separation, arming, and firing delay.

Many S&A devices utilize setback acceleration as the sensed arming environment. Examples of prior devices used to detect and integrate the setback acceleration environment include G-weight driven escapements, successive falling leaves, zig-zag G-weights and variations and combinations of these. Most of these examples suffer from several drawbacks including having a plethora of parts, requiring close tolerances, and having limited accuracy and reliability.

It has been found desirable to combine the higher reliability and accuracy of electronics for timing and control functions for the safety afforded by mechanical obstruction of a firing train. By doing so, major improvements in performance, reliability, and producibility are provided.

Therefore, there arises a need for a mechanical S&A device for arming the explosive projectile, which may be used in combination with an electronic timing and logic device. Further, there arises a need for an S&A device which prevents fuze arming prior to sensing a credible launch event, prevents arming while in-bore, and prevents aligning the firing train until safe separation from the gun tube is achieved. Such device should also provide a degree of modularity so that it can be used in both electrical and mechanical fuze environments. The present invention directly addresses and overcomes the shortcomings of the prior art.

SUMMARY OF THE INVENTION

The present invention provides a simple and reliable safety and arming apparatus and method. The S&A device utilizes setback acceleration for in-bore safety and sustained in-bore acceleration to position various members to allow for subsequent alignment of the firing train at arm time. Therefore, credible launch related parameters are used to enhance safety in the S&A function. Additionally, the invention bridges the gap between existing technology and developing future products in the munitions fuze area.

As noted above, the present invention is useful in high G force environments—such as in explosive projectiles fired from tanks. However, it should be apparent to those skilled in the art upon a reading of the present specification that the invention is also applicable to other environments. Therefore, while the tank example will be discussed herein, the present invention is not so limited, and various aspects may be applied to large artillery and rocket style munition fuze applications.

In a preferred embodiment constructed according to the principles of the present invention, a safe and arm assembly for safely arming the projectile and later initiating the explosion is provided in a fuze assembly. The S&A assembly includes a rotor having a bore hole formed therein containing a lead and which selectively interrupts the initiating explosive train. The explosive interface between a detonator and a lead is unimpeded when the bore hole is in-line with a second corresponding hole in a protective cover. The rotor is normally secured by a setback lock. Upon firing, an in-bore lock (in conjunction with a retaining collar) moves down at a low acceleration level to additionally secure the rotor out-of-line while the projectile is in the gun tube. The movement of the in-bore lock also removes an impact drive surface for a piston actuator on the rotor, which eliminates the possibility of an in-bore-arming in the event of an inadvertent firing of the piston actuator.

During the period in the gun tube, the setback lock also swings down under a predetermined high acceleration and causes the setback lock to latch, leaving the in-bore lock and a shear/break-away tab holding the rotor. Once out of the gun tube, the in-bore lock releases, leaving the rotor free (except for the shear tab which is overcome by the piston actuator) and restoring the impact drive surface of the piston actuator on the rotor. The electrically activated piston actuator is positioned to rotate and lock the rotor in line such that the detonator, bore holes in the rotor and cover are aligned for target initiated detonation. The piston actuator is controlled by an electronics assembly.

One feature of the present invention is a safe and arm (S&A) mechanism having an electro-mechanical out-of-line safety for providing first and second environment safety, preventing in-bore arming, providing a high order initiation of a booster, and significantly lowering parts count over existing fuze systems. In the preferred embodiment, a piston actuator properly breaks a shear tab and turns the rotor about its axis to arm the projectile so that there is a significant reduction in parts count in the S&A, thus reducing cost.

Another feature of the present invention is in the use of a setback lock provided for inhibiting rotary movement of the rotor until first environment setback acceleration occurs. The impact drive surface of the rotor is not available as a target area to the piston actuator until the in-bore lock has been returned to the arm enable position subsequent to bore exit. Therefore, inadvertent firing of the piston actuator prior to a first environment occurrence does not arm the projectile. In safety tests, it has been determined that the preferred S&A apparatus can be dropped 40 feet without latching the setback lock. However, in functional tests the setback lock successfully latches under sustained acceleration on the order of 20,000 G's.

The preferred embodiment includes yet another feature to promote safety. A shear tab is cast on the side of the rotor which engages a slot in the S&A housing. This prevents the rotor, containing the explosive transfer lead, from being assembled to the S&A in any position other than full safe.

Therefore, according to one aspect of the present invention, there is provided an S&A apparatus for arming an explosive projectile, comprising: (a) a housing; (b) a rotor rotatable about an axis and operatively connected to said housing, said rotor having a hole defined therein, wherein said hole is aligned generally parallel to said axis and is arranged and configured to hold a lead; (c) setback lock means, operatively connected to said housing, for selectively inhibiting rotation of said rotor; and (d) biasing means, operatively connected to said housing and said setback lock means, for normally biasing said setback lock means into a first position which inhibits rotation of said rotor and for allowing said setback lock means to move into a second position out of the path of said rotor upon a predetermined acceleration of the projectile, wherein after the predetermined acceleration of the projectile occurs, rotation of said rotor orients said hole in-line with an explosive train to arm the projectile.

While the invention will be described with respect to a preferred embodiment S&A device and with respect to particular components used therein, it will be understood that the invention is not to be construed as limited in any manner by either such configuration or components described herein. Further, while the preferred embodiment of the invention will be described in relation to an exploding projectile which is fired from a tank, it will be understood that the scope of the invention is not to be limited in any way by the environment in which it is employed. The principles of this invention apply to the safety and arming of an exploding projectile. Finally, it will be apparent to those skilled in the art that while the preferred embodiment used herein relates to a first sensed environment, the sensed environment could also comprise a second or other sensed environment.

These and other various advantages and features which characterize the invention are pointed out with particularity in the claims annexed hereto and forming a part hereof. However, for a better understanding of the invention, its advantages and objectives obtained by its use, reference should be had to the drawing which forms a further part hereof and to the accompanying descriptive matter, in which there is illustrated and described a preferred embodiment to the invention.

BRIEF DESCRIPTION OF THE DRAWING

Referring to the Drawing, wherein like numerals represent like parts throughout the several views:

FIG. 2 is an enlarged perspective view of the setback lock of FIG. 1;

FIG. 3 is an enlarged perspective view of the rotor of FIG. 1;

DETAILED DESCRIPTION OF THE PREFERRED EMBODIMENT

As mentioned above, the principles of this invention apply to a safe and arm assembly for an explosive projectile for a tank. The preferred embodiment is intended to operate in a system environment having a setback acceleration in excess of 55,000 G's and a temperature range from −25° to +140°. Further, the preferred embodiment is operable in a projectile having little or no spin, an in-bore time ranging from 8 to 12 milliseconds and a free flight time up to 8 seconds.

Figure 6A:
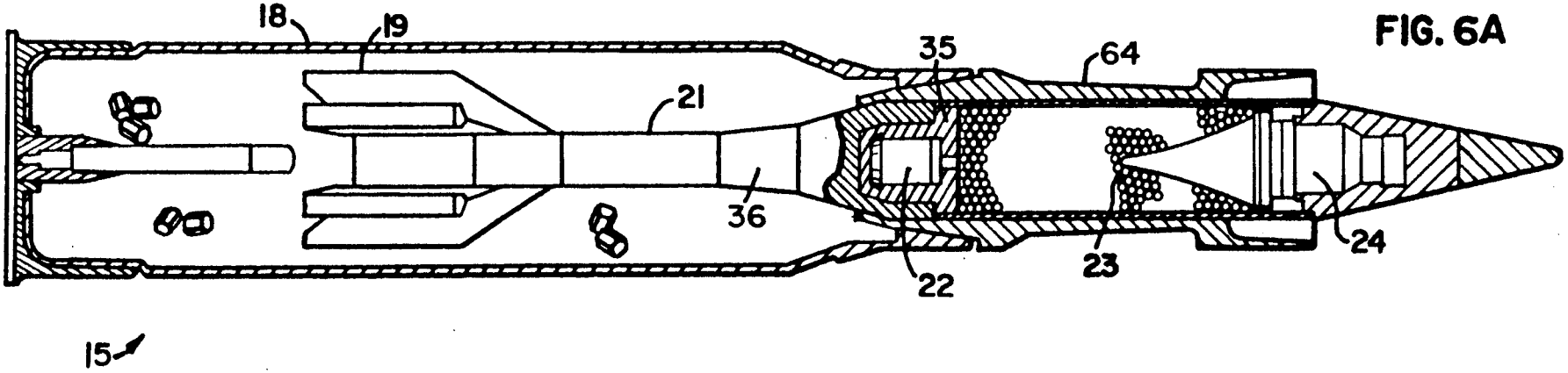
FIGS. 6A, 6B and 6C depicts a projectile having a base element fuze and S&A apparatus in accordance with the principles of the present invention.
Figure 6C:
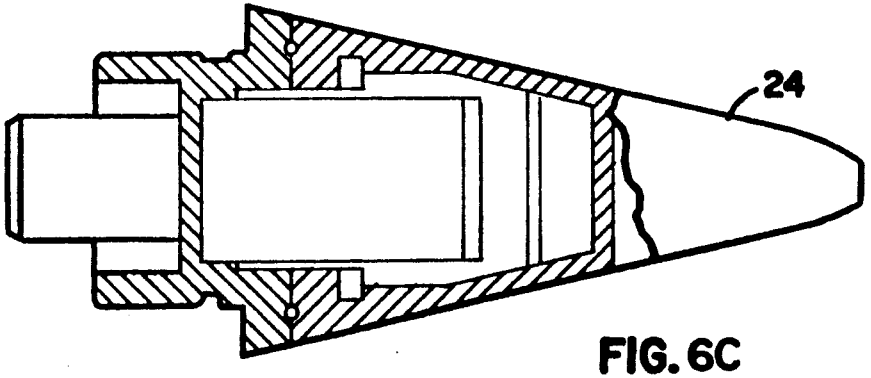
Figure 6B:
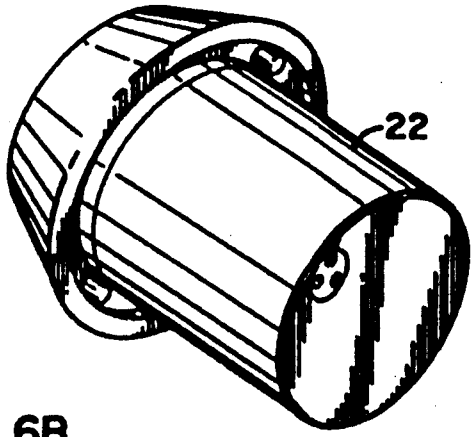

In order to better understand the present invention, the description of the preferred embodiment S&A apparatus will be deferred pending a description of an explosive projectile in which the S&A apparatus might be used. Thus, reference is now made to FIGS. 6A, 6B and 6C which depict an explosive projectile (hereafter referred to as a "projectile") having a base element fuze in accordance with the principles of the present invention. The projectile is illustrated generally at 15. In the preferred embodiment, the projectile 15 is depicted as a 120 mm tank round manufactured by Alliant Techsystems Inc. of Minneapolis Minn., having a designation of M830A1. Those skilled in the art will be able to bring to mind other suitable large caliber munitions devices for which the principles of the present invention may be suitable and/or practiced.

The projectile 15 is mounted in a cartridge 18 for insertion into a launch tube such as a tank barrel (i.e., the breech end of the bore of a tank gun). The projectile 15 comprises a fin and tracer assembly 19 coupled through a fin adapter 21 to a body 23 containing a base element assembly 22. A sabot 64, described in more detail herein below, shrouds the projectile 15 to prevent propellant gases from escaping around the projectile 15 during firing and to assist acceleration of the projectile 15 down the tube. At the frontal portion of the projectile 15 is disposed a nose cone 24 containing, inter alia, impact and proximity sensors to generate a detonation signal to the projectile electronics (described in more detail herein below).

Figure 7:
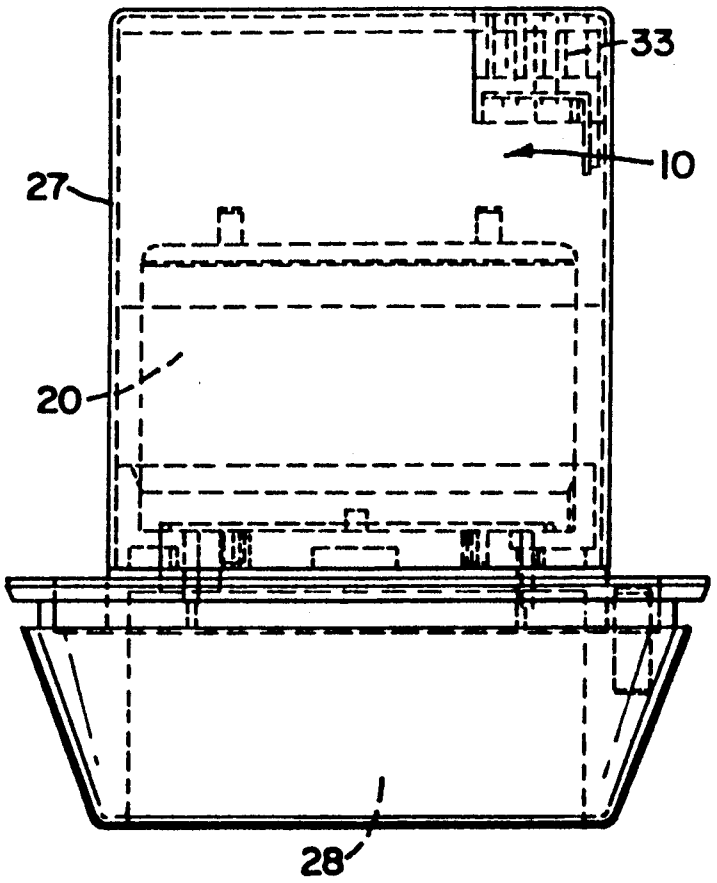
FIG. 7 depicts the form factor of the base element fuze in more detail and the location of the subassemblies within the fuze.

Reference is now made to FIG. 7 which depicts the form factor of the base element assembly 22 in more detail and the location of the subassemblies therein. The base element assembly 22 comprises a case 27 which houses a battery assembly 20, a S&A assembly 10, electronic assembly 28, and connector 33. These assemblies and the workings of an electro-mechanical base element fuze are the subject of a corresponding copending patent application commonly assigned to the assignee of the present application. Such corresponding application is titled "Electro-Mechanical Base Element Fuze" and is being filed on Jun. 19, 1992 concurrently herewith, and received Ser. No. 07/901,381, the inventors being Gregory F. Filo, Dennis L. Kurschner and Paul L. Weber. Such application is hereby incorporated herein by reference.

Figure 1:
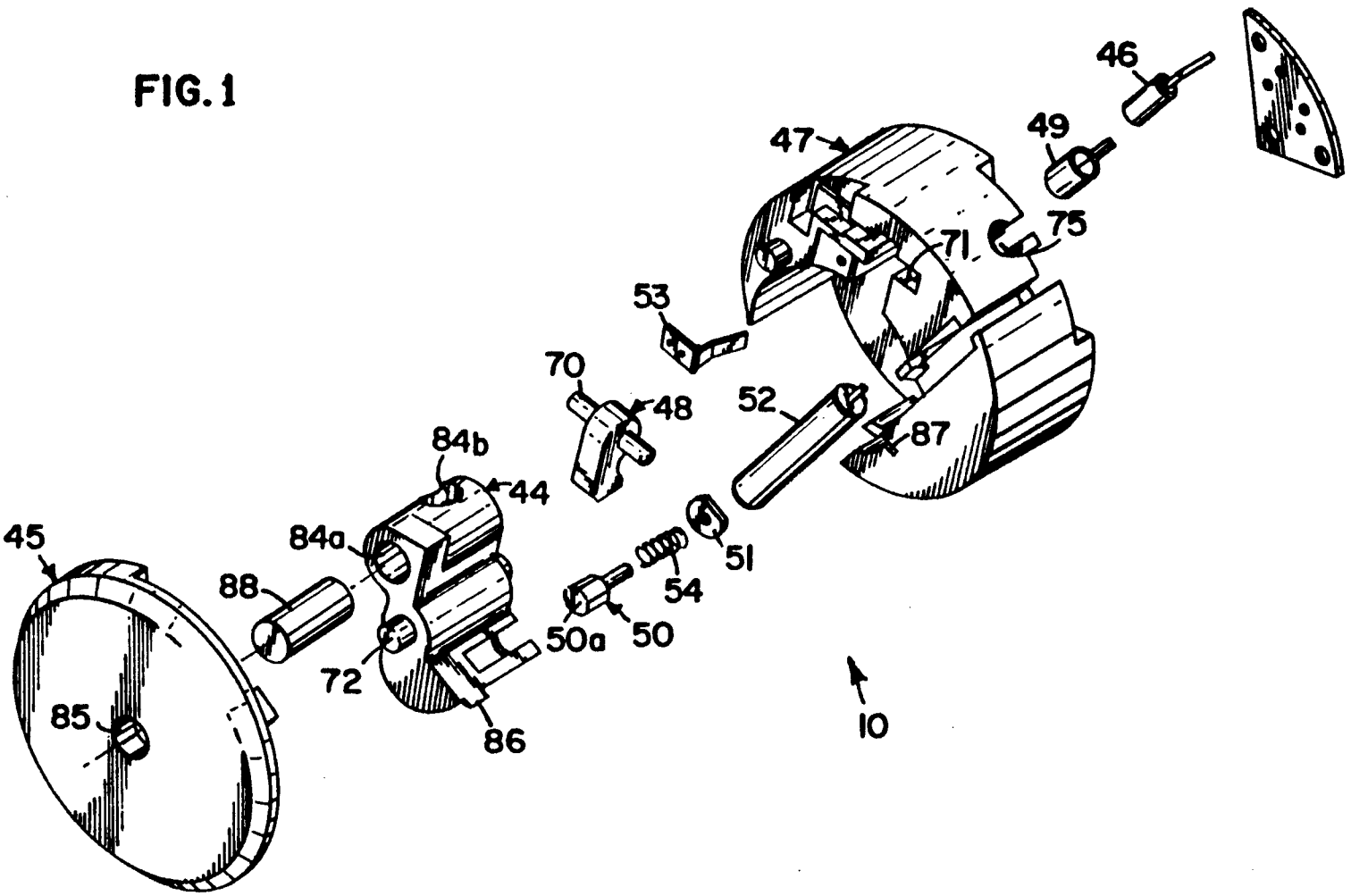
FIG. 1 is an exploded view of an S&A device constructed in accordance with the principles of the present invention.

Referring next to FIG. 1, there is illustrated an S&A apparatus 10 constructed in accordance with the principles of the present invention. The S&A apparatus 10 senses set back acceleration for first environment safety. The sensor for the first environment safety is a semiintegrating compound pendulum 48 (best seen in FIG. 2) which is capable of distinguishing the acceleration differences between a normal launch and other impact, such as accidental dropping of the round. The sensor comprises the set back lock and includes a cantilevered rotating pendulum 48 and associated torsion bar spring 55. The pendulum rotates about arms 70 which cooperate within a channel 71 defined in the housing 47. The spring 55 is sized, arranged, and configured to produce a significant preload torque on the pendulum 48 at zero and low setback acceleration. What is meant by "low setback acceleration" for the purposes of this discussion is less than 2500 G. By providing such a preload torque on pendulum 48, the pendulum 48 is in essence locked into its original state/position during ambient or non-firing conditions. This original state defines the pendulum's 48 first position.

Prior to exposure to a credible launch environment, the setback lock prevents the rotor 44 from movement about its rotational axis 72. As projectile 15 acceleration increases, the torque on the setback lock caused by the acceleration acting on the cantilevered mass (i.e., the majority of the mass of pendulum 48 is cantilevered from arms 70; the mass is designated as 48*a* in FIG. 2) increases until it exceeds the preload torque on the spring 55. At a certain point when the preload torque on the spring 55 is overcome, the mass 48*a* moves downward (i.e., mass 48*a* rotates toward the housing 47 and away from cover 45; such rotation is due to acceleration and inertial forces). As it moves, the moment arm of the pendulum 48 rapidly decreases with respect to the direction of acceleration. Therefore, significantly greater levels of acceleration are required to drive the pendulum fully out of the safe/first position. The spring 55 will return the pendulum to the first position if either the magnitude or duration of the acceleration pulse is less than what would be experienced in a credible launch.

Those skilled in the art will recognize that proper acceleration differences include both the magnitude of the acceleration and the duration—which may be thought of analogous to an amplitude and a pulse width. Since the characteristics are both known prior to a credible launch event, the S&A apparatus 10 can utilize the amplitude and duration to identify a proper signature for a credible launch environment. By doing so, spurious or other non-launch events may be ignored and/or overcome by the S&A apparatus 10 to avoid detonation of the explosive projectile 10 except in those instances when a credible launch event has occurred.

In order for the pendulum 48 to rotate to the full arm enable position, the spring 55 must be deflected through its elastic yield point. The spring 55 is designed such that shock impulses caused by exposure to a 40 foot free fall impact is significantly less than what is required for permanent spring 55 deflection. However, exposure to a credible (i.e., sufficient amplitude and duration) launch acceleration fully deflects the spring 55. When the pendulum rotates into the full arm enable position (which defines its second position), a small protrusion 56 on the side of the pendulum 48 engages an adjacent lead spring 53 mounted to the S&A housing 47. The leading edge of the protrusion 56 is chamfered to drive the latch spring 53 away from the pendulum 48 as it passes by. When the protrusion 56 clears the latch spring 53, the spring 53 returns to its original position and prevents pendulum 48 rotation back to the first/safe position. In this manner, the latch spring 53 acts as a type of pawl to overcome the protrusion.

Figure 4:
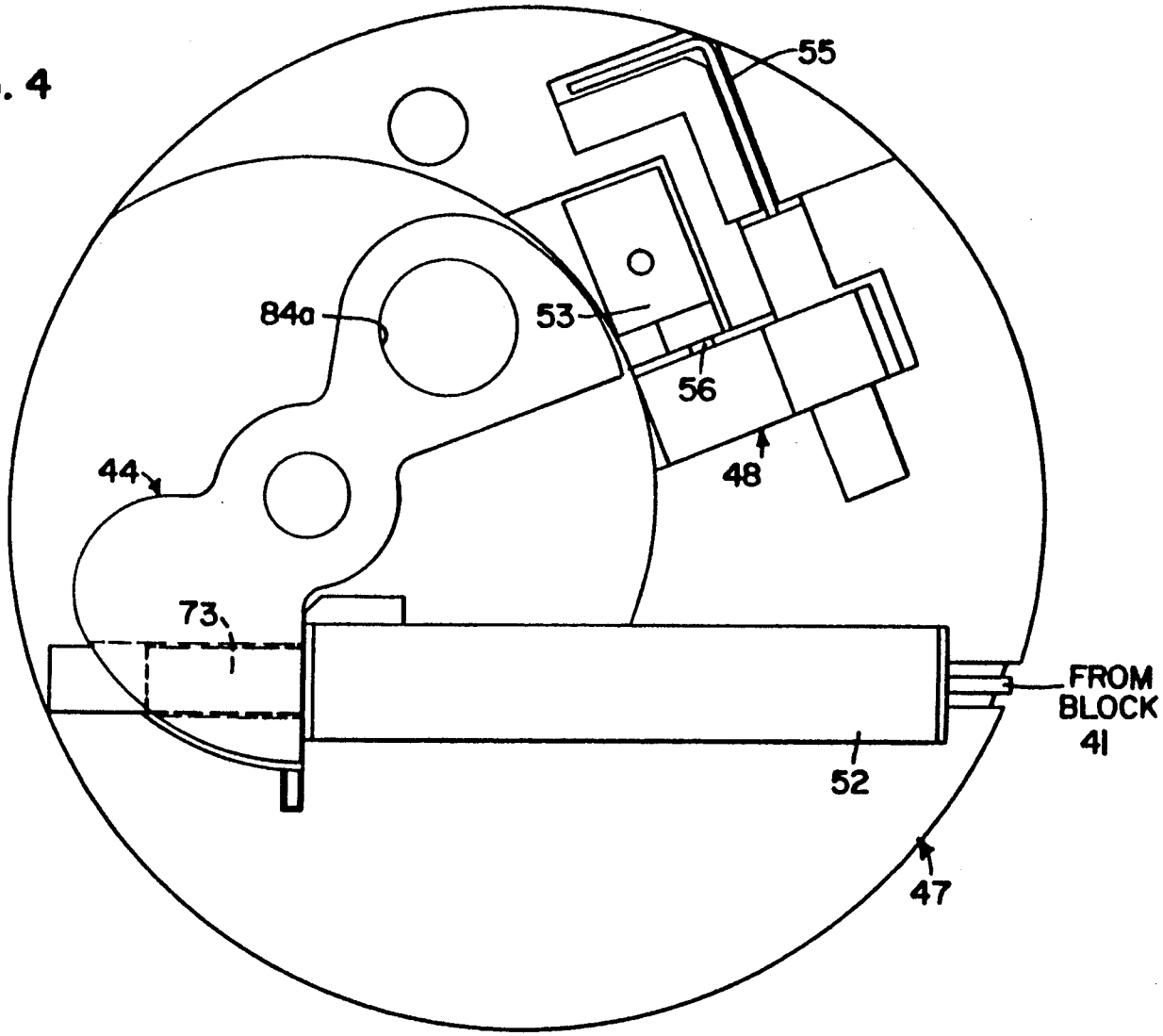
FIG. 4 is a top plan view of the piston passed through the rotor of FIG. 1.

The S&A apparatus 10 prevents in-bore arming of the fuze utilizing a setback activated locking pin 50. The in-bore lock pin 50 is parallel to the rotational axis of the rotor (best seen in FIGS. 2 and 3). A compression spring 54 maintains the head of the pin 50*a*, which provides the impact surface for the electronically controlled actuator 52, in its arm enable position. As the projectile 15 experiences acceleration during launch, the mass of the pin 50 drives against the spring 54, resulting in two positive safety conditions. First, the impact surface 50*a* for the piston actuator 52 is removed; if it should fire for whatever reason, the piston rod 73 would engage the hole left by the head of the pin 50*a*, positively locking the rotor 44 in the safe position (best seen in FIG. 4). Second, as the lock pin 50 moves down through its spring retaining washer 51 it engages a mating hole in the S&A housing (not shown) which locks the rotor 44 in place until the acceleration of the projectile 15 decreases to a point below the compression level of the spring 54. Spring 54 is sized and configured such the spring does not force the pin 50 back into its original unlocked/arm enable position until after muzzle exit. At muzzle exit, set back acceleration goes to zero and the compression spring 54 drives the lock pin 50 back to its arm enable position within several milliseconds.

Unlike other devices, set forward acceleration is not required for this S&A apparatus 10 to return the in-bore lock (comprised of the pin 50, spring 54, washer 51, and optionally piston 73 and the mating hole in housing 47) to its original position. Due to the sizing of the spring 54, the in-bore lock fully activates prior to the set-back lock moving from the safe/first position, providing a safety overlap of the two mechanisms. If either the pin 50 or compression spring 54 is omitted during S&A assembly, the device will fail safe since the impact surface for the piston actuator 52 will not be in place.

Alignment of the rotor 44 to the armed position is accomplished with a piston actuator 52. In operation, when the round exits the gun tube, the in-bore lock returns to its arm enabled position, the second environment for arming is experienced (best seen in block 90 of FIG. 8), and the fuze electronics (best seen in block 91 of FIG. 8) activates the safe separation timer. At the proper time, a piston actuator fire signal is generated by electronics block 91, and the piston actuator 52 is fired. The piston 73 then impacts the head 50*a* of the in-bore lock pin 50. The rotor shear tab 86 engaging the S&A housing 47 in channel 87 shears off, allowing the rotor 44 to rotate about its axis 72. As the piston 73 extends, it slides off the head 50*a* of the in-bore pin 50 and along the impact face 74 of the rotor 44. The rotor 44 stops in the second/armed position and is locked there by the full extension of the piston 73 beyond the outer edge of the rotor 44 (see FIG. 5).

Preferably, a window (not shown) is located in the top of the fuze assembly to allow for visual indication of the fuze status. In the safe position the letter S in white on a green background is visible. In the arm position the letter A in black on fluorescent red or fluorescent orange background is visible.

Figure 5:
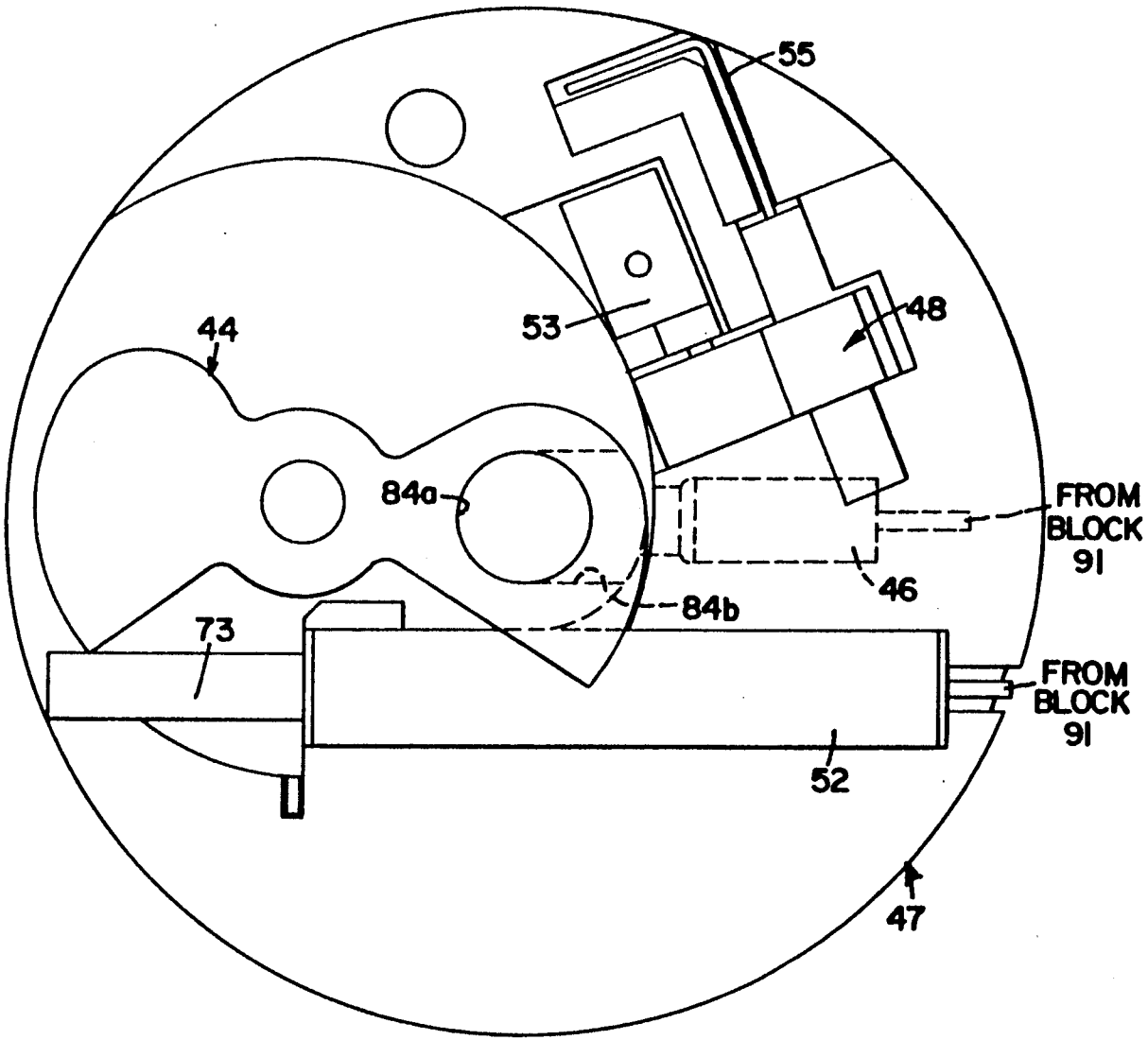
FIG. 5 is a top plan view of the piston having flipped past the rotor such that the S&A is in the full arm state.

In the preferred embodiment, the firing train consists of an M100 microdetonator and a PBXN-5 explosive transfer lead, see FIG. 5. The detonator 46 is mounted in a ground clip 49 which fits within the S&A housing 47 in aperture 75 (which is normal to the center axis of the S&A apparatus 10). The detonator 46 output is aimed through the center line of the S&A apparatus 10 and is initiated by a signal from the fuze electronics block 91. The transfer lead 88 is contained in the rotor 44, whose rotational axis 72 is parallel to the center axis of the S&A apparatus 10. When the rotor 44 is in the second position, the transfer lead 88 is aligned along the center axis of the S&A apparatus 10 and is exposed to the detonator output via window **84*b* in the rotor 44. The sizing of the lead 88 provides for maximum tolerancing on the alignment of the detonator output to the transfer lead 88. The lead 88** is capable of initiating a wide variety of explosive types, including insensitive types.

When the rotor is 44 in the safe/first position, the transfer lead 88 is maintained at 55° out of alignment with the center axis of the S&A apparatus 10 and the window **84*b* is shielded from the explosive output of the detonator 46. This prevents initiation of the projectile 15 if the detonator 46** is inadvertently activated prior to the fuze being properly armed.

Figure 9:
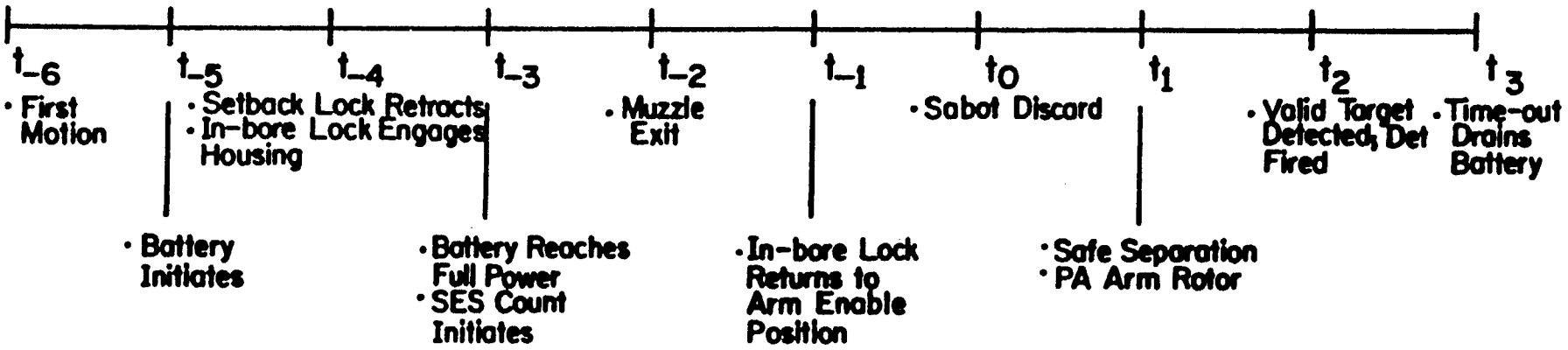
FIG. 9 is a time line depicting the temporal relationship of events in the present invention.

Reference is made now to FIG. 9 which depicts the temporal occurrences of major events in the present invention. First motion occurs at time $t_{-6}$ which causes a battery to initiate at time $t_{-5}$. After the battery initiates at $t_{-5}$ the functions in the S&A apparatus 10 begin to occur. At time $t_{-4}$ the in-bore lock pin 50 retracts and engages the S&A housing 47. At time $t_{-3}$ (typically less than 5 milliseconds) the battery reaches sufficient power to turn on electronics block 91 and a first timer is initiated for detecting a second environment condition by block 90. In the preferred embodiment, the first timer is started to window the release of the sabot 64 which should occur at time $t_0$. However, other suitable events for second environment conditions might also be used. At time $t_{-2}$ (typically on the order of 8 milliseconds) the projectile 15 exits the muzzle. At time $t_{-1}$ the in-bore lock 50 releases leaving the rotor 44 free (except for the shear tab 86) and restoring the impact drive surfaces (**50*a* and 74) of piston actuator 52 on the rotor 44. At time $t_0$ (typically 9–14 milliseconds from launch initiation) the sabot 64 is discarded triggering the second environment condition. If the second environment event occurs before the first timer expires, a second timer is initiated to generate a safe separation time. The safe separation time is the point at which the projectile 15 will actually arm (i.e., the rotor 44 moves to its second position bringing the explosive train in-line) provided all fuze functions (i.e., acceleration environments, sabot release, timing, etc.) occur correctly. At time $t_1$, the safe separation distance, the piston actuator 52 receives a fire signal from electronics block 91, and the rotor 44 is rotated and locked in-line thereby arming the projectile 15. At time $t_2$ a valid target is detected by impact and proximity switches 92 and the detonator 46 receives a fire control signal from electronic block 91**. At time $t_3$, the maximum mission timeout occurs if a valid target is not detected and the battery is drained.

The second environment sensor 90 is a safety related function. The sensor 90 detects the release of the sabots 64 after the projectile 15 has left the bore. The second environment sensor 90 is the subject of a corresponding copending patent application commonly assigned to the assignee of the present application. Such corresponding application is titled "Magnetic Sensor Arming Apparatus and Method for an Explosive Projectile" and is being filed on Jun. 19, 1992 concurrently herewith, and received Ser. No. 07/901,392, the inventors being Dennis L. Kurschner and Gregory F. Filo. Such application is hereby incorporated herein by reference.

Figure 8:
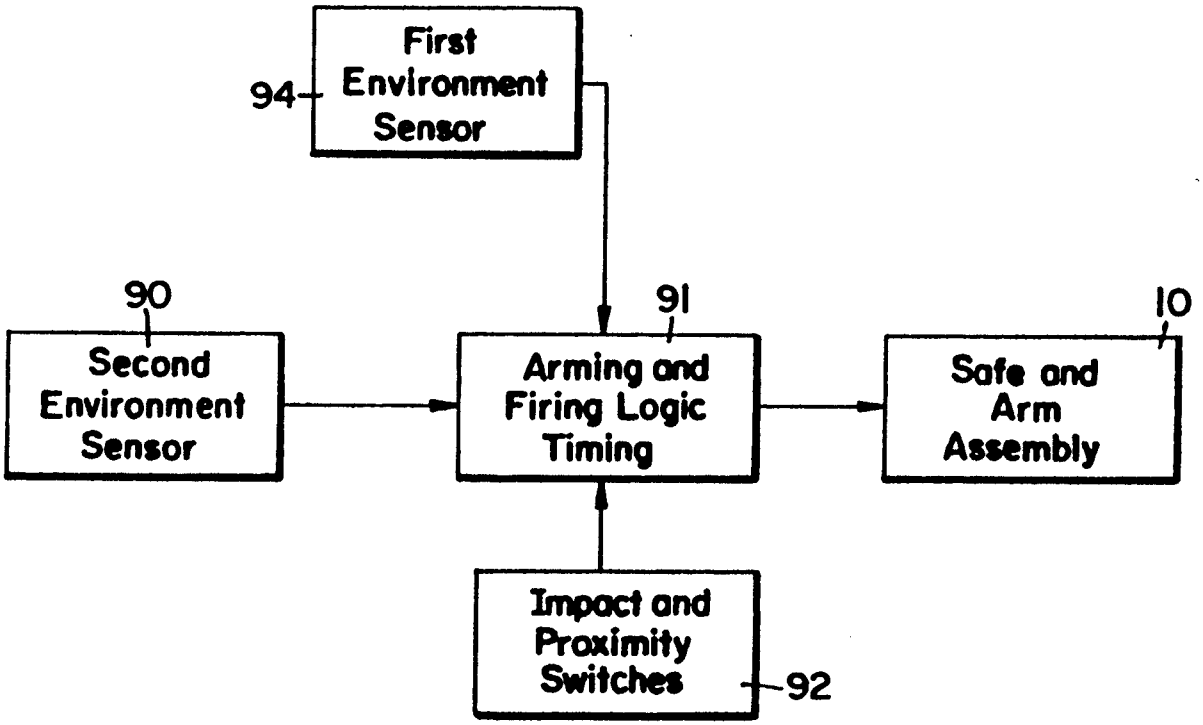
FIG. 8 is a block diagram illustrating the various functional blocks of a fuze device in which the present S&A apparatus may be utilized.

The nose cone 24 contains various sensors designated as block 92 in FIG. 8. These sensors include a proximity sensor, a frontal impact switch for hard target impact and crush switch for graze or high obliquity target impact. Detonation can be initiated by a trembler switch being activated at 2,000–3,000 G's (side swipe or soft target impact), the frontal impact switch being activated at 20,000–25,000 G's (a direct hit), the crush switch being activated (oblique hit), or the proximity sensor being activated (standoff attack).

While a particular embodiment of the invention has been described with respect to its application for sensing first environment, providing in-bore safety, and providing credible post launch alignment of the initiating lead to the explosive, it will be understood by those skilled in the art that the invention is not limited by such application or embodiment, or by the particular components disclosed and described herein. It will be similarly appreciated by those skilled in the art that other circuit configurations and applications therefor other than as described herein can be configured within the spirit and intent of this invention. The configuration described herein is provided as only one example of an embodiment that incorporates and practices the principles of this invention. Other modifications and alterations are well within the knowledge of those skilled in the art and are to be included within the broad scope of the appended claims.

What is claimed is:

1. A safe and arm apparatus for arming an explosive projectile, comprising:

(a) a housing;

(b) a rotor rotatable about an axis and operatively connected to said housing, said rotor having a hole defined therein, wherein said hole is aligned generally parallel to said axis and is arranged and configured to hold a lead, wherein said rotor rotates between a safe position and an armed position;

(c) setback lock means, operatively connected to said housing, for selectively inhibiting rotation of said rotor between said safe and armed positions;

(d) biasing means, operatively connected to said housing and said setback lock means, for normally biasing said setback lock means into a first position which inhibits rotation of said rotor and for allowing said setback lock means to move into a second position out of the path of said rotor upon a predetermined acceleration of a projectile; and (e) rotating means for rotating said rotor, operatively connected to said housing, wherein after the predetermined acceleration of the projectile occurs, rotation of said rotor orients said hole in-line with an explosive train to arm the projectile, and wherein said rotating means includes a controllable drive member which is arranged and configured to impact a surface on said rotor to rotate said rotor.

2. The apparatus of claim 1, wherein said controllable drive member is a piston actuator.

3. The apparatus of claim 1, wherein said setback lock is comprised of a pivotable cantilevered mass and said biasing means is a torsion spring.

4. The apparatus of claim 3, wherein said mass includes a protrusion which moves past a pawl so as to lock said mass in said second position.

5. The apparatus of claim 1, further comprising in-bore lock means for locking said rotor upon an initial setback acceleration of the projectile, whereby the initial setback acceleration corresponds to the projectile being located within a bore of a device from which the projectile is fired.

6. The apparatus of claim 5, wherein said in-bore lock means includes a pin biased by a spring, said pin being arranged and configured to reside within a recess in said rotor, and wherein said pin moves due to inertial forces at setback acceleration against said spring so as to engage said housing, wherein said rotor is locked while in the bore.

7. The apparatus of claim 6, wherein said spring is arranged and configured to bias said pin back within said recess subsequent to setback acceleration.

8. The apparatus of claim 7, wherein said controllable drive member is a piston actuator, said piston actuator impacting said pin when said pin is set back within said recess, wherein said pin comprises said impact surface, and whereby inadvertent firing of said piston actuator during setback acceleration does not arm the safe and arm apparatus.

9. A safe and arm apparatus for arming an explosive projectile, comprising:

(a) a housing;

(b) a rotor rotatable about an axis and operatively connected to said housing, said rotor having a hole defined therein, wherein said hole is aligned generally parallel to said axis and is arranged and configured to hold a lead, wherein said rotor rotates between a safe position and an armed position and wherein said hole includes a side bore extending from said hole through the circumference of said rotor, wherein when said rotor is in said armed position then said side bore is aligned with a detonator which is located in said housing, whereby said lead is exposed to said detonator, and wherein when said rotor is in said safe position then said lead is not in-line, whereby said lead is shielded from said detonator;

(c) setback lock means, operatively connected to said housing, for selectively inhibiting rotation of said rotor between said safe and armed positions, wherein said setback lock means includes a pivotable cantilevered mass;

(d) biasing means, operatively connected to said housing and said setback lock means, for normally biasing said setback lock means into a first position which inhibits rotation of said rotor and for allowing said setback lock means to move into a second position out of the path of said rotor upon a predetermined acceleration of a projectile; and (e) means for rotating said rotor, operatively connected to said housing, wherein after the predetermined acceleration of the projectile occurs, rotation of said rotor orients said hole in line with an explosive train and said side bore with said detonator to arm the projectile.

10. A safe and arm apparatus for providing an out-of-line safety between an explosive train and a detonator until preselected conditions occur, comprising:

(a) a rotor having a bore hole therethrough, said rotor having a first out-of-line position for impeding a path between a detonator and an explosive and a second in-line position defining an armed position;

(b) means, engagable with said rotor, for rotating said rotor about its axis and into said second in-line position;

(c) an in-bore lock operatively connected to said rotor to selectively restrain said rotor from moving from said first out-of-line position to said second in-line position, wherein upon launch said in-bore lock secures said rotor out-of-line while the projectile is within the gun tube, said in-bore lock removing a rotor impact surface comprised of said lock from said means for rotating said rotor thus eliminating a possibility of in-bore arming of the projectile, once out of the gun tube, said in-bore lock releases and restores said rotor impact surface to said piston actuator; and (d) a setback lock for holding back said rotor wherein at maximum acceleration of the projectile, said setback lock swings in a downwardly direction to latch leaving said in-bore lock and a shear tab holding said rotor.

11. The apparatus of claim 10, wherein said means for rotating said rotor is an electrically activated piston actuator.

12. The apparatus of claim 10, further comprising detonator means for receiving a detonation control signal and for initiating an explosive train when said hole in said rotor is in line.

13. The apparatus of claim 10, wherein said means for rotating said rotor are responsible to a control signal and wherein said means for rotating said rotor are sized and configured to shear said shear tab.

14. The apparatus of claim 13, wherein said means for rotating said rotor is an electrically activated piston actuator which receives said control signal and explosively drives a piston into said rotor impact surface to rotate said rotor.

15. A method of arming an explosive projectile, comprising the steps of:

(a) initially inhibiting the rotation of a rotor with a setback lock device;

(b) biasing said setback lock device into a first position which inhibits rotation of said rotor and into a second position out of the path of said rotor upon a predetermined acceleration of the projectile;

(c) striking a surface of said rotor with a piston actuator to rotate said rotor so as to bring an explosive train in-line after the predetermined acceleration of the projectile occurs, wherein the rotation of said rotor orients a detonator in-line with an explosive lead through a side bore in said rotor; and (d) aligning said explosive lead in-line by rotating said rotor to arm the projectile.

16. A safe and arm apparatus for arming an explosive projectile, comprising:

(a) a housing;

(b) a rotor rotatable about an axis and operatively connected to said housing, said rotor having a hole defined therein, wherein said hole is aligned generally parallel to said axis and is arranged and configured to hold a lead, wherein said rotor rotates between a safe position and an armed position;

(c) setback lock means, operatively connected to said housing, for selectively inhibiting rotation of said rotor between said safe and armed positions, wherein said setback lock means includes a pivotable cantilevered mass;

(d) biasing means, operatively connected to said housing and said setback lock means, for normally biasing said setback lock means into a first position which inhibits rotation of said rotor and for allowing said setback lock means to move into a second position out of the path of said rotor upon a predetermined acceleration of a projectile, and wherein said biasing means includes a torsion spring; and (e) means for rotating said rotor, operatively connected to said housing, wherein after the predetermined acceleration of the projectile occurs, rotation of said rotor orients said hole in-line with an explosive train to arm the projectile.

17. The apparatus of claim 16, wherein said mass includes a protrusion which moves past a pawl so as to lock said mass in said second position.

18. The apparatus of claim 16 further comprising in-bore lock means for locking said rotor upon an initial setback acceleration of the projectile, whereby the initial setback acceleration corresponds to the projectile being located within a bore of a device from which the projectile is fired.

19. The apparatus of claim 18, wherein said in-bore lock means includes a pin biased by a spring, said pin being arranged and configured to reside within a recess in said rotor, and wherein said pin moves due to inertial forces at setback acceleration against said spring so as to engage said housing, wherein said rotor is locked while in the bore.

20. The apparatus of claim 19, wherein said spring is arranged and configured to bias said pin back within said recess subsequent to setback acceleration.

* * * * *